US009135824B1

(12) United States Patent
Collar

(10) Patent No.: US 9,135,824 B1
(45) Date of Patent: Sep. 15, 2015

(54) RED LIGHT VIOLATOR WARNING

(71) Applicant: Siemens Industry, Inc., Alpharetta, GA (US)

(72) Inventor: Benjamin Collar, Austin, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 60 days.

(21) Appl. No.: 14/192,050

(22) Filed: Feb. 27, 2014

(51) Int. Cl.
*G08G 1/16* (2006.01)

(52) U.S. Cl.
CPC ..... *G08G 1/166* (2013.01)

(58) Field of Classification Search
CPC ..... G08B 1/166; G08B 1/096; G08G 1/095
USPC ..... 340/933, 930, 937, 902, 905; 701/117, 701/118
See application file for complete search history.

(56) References Cited

U.S. PATENT DOCUMENTS

| | | | | |
|---|---|---|---|---|
| 7,986,339 | B2 * | 7/2011 | Higgins | 348/149 |
| 8,681,018 | B2 * | 3/2014 | McNamara et al. | 340/905 |
| 2003/0016143 | A1 | 1/2003 | Ghazarian | |
| 2009/0224942 | A1 * | 9/2009 | Goudy et al. | 340/905 |
| 2010/0073194 | A1 | 3/2010 | Ghazarian | |
| 2010/0106413 | A1 * | 4/2010 | Mudalige | 701/213 |
| 2011/0187559 | A1 | 8/2011 | Applebaum | |

OTHER PUBLICATIONS

European Search Report mailed May 20, 2015 corresponding to European Application No. 15156724.5 filed Feb. 26, 2015 (10 pages).

* cited by examiner

*Primary Examiner* — Tai T Nguyen

(57) ABSTRACT

Embodiments include a method for providing a red light violator warning. The method includes detecting that a first vehicle is about to violate a red light at an intersection. Based on detecting that the first vehicle is about to violate the red light at the intersection, the method includes broadcasting a warning message to all connected vehicles in proximity of the intersection of a pending red light violation and determining if the first vehicle is a connected vehicle. Based on determining that the first vehicle is a connected vehicle, the method further includes transmitting a notification message to the first vehicle warning of a pending red light violation.

20 Claims, 3 Drawing Sheets

RED LIGHT VIOLATOR WARNING

BACKGROUND

The present invention relates generally to traffic control systems and more specifically to, a red light violator warning system.

In general, traffic management systems are utilized to control the operation of traffic signals along arterial roads. The goal of the traffic management system is to maximize vehicle throughput on the arterial road while minimizing delays. Traffic signal controllers are used to control the operation of traffic signals along the arterial roads and to adjust the signal phasing and timing based on the time and day of the week.

Currently, many traffic management systems include red light violator detection systems that are configured to detect the violation of red light and to record the violations. These red light violator detection systems typically include one or more sensors that are configured to detect that a vehicle has violated a camera that captures one or more images of the violation, such as images of the driver of the vehicle and the license plate of the vehicle.

While red light violator detection systems are useful for detecting the violation of a red light and providing data to generate a citation for the offending driver, the red light violator detection systems are not configured to enhance the safety of the intersection by alerting the other drivers in the intersection that a red light violation is about to occur.

SUMMARY

According to one embodiment, a method for providing a red light violator warning includes detecting that a first vehicle is about to violate a red light at an intersection. Based on detecting that the first vehicle is about to violate the red light at the intersection, the method includes broadcasting a warning message to all connected vehicles in proximity of the intersection of a pending red light violation and determining if the first vehicle is a connected vehicle. Based on determining that the first vehicle is a connected vehicle, the method further includes transmitting a notification message to the first vehicle warning of a pending red light violation.

According to another embodiment, a roadside equipment having a processor configured to operate a traffic signal for an intersection is provided, the processor configured to perform a method that includes detecting that a first vehicle is about to violate a red light at an intersection. Based on detecting that the first vehicle is about to violate the red light at the intersection, the method includes broadcasting a warning message to all connected vehicles in proximity of the intersection of a pending red light violation and determining if the first vehicle is a connected vehicle. Based on determining that the first vehicle is a connected vehicle, the method further includes transmitting a notification message to the first vehicle warning of a pending red light violation.

According to yet another embodiment, a computer program product for providing a red light violator warning is provided. The computer program product includes a tangible storage medium readable by a processing circuit and storing instructions for execution by the processing circuit for performing a method. The method includes detecting that a first vehicle is about to violate a red light at an intersection. Based on detecting that the first vehicle is about to violate the red light at the intersection, the method includes broadcasting a warning message to all connected vehicles in proximity of the intersection of a pending red light violation and determining if the first vehicle is a connected vehicle. Based on determining that the first vehicle is a connected vehicle, the method further includes transmitting a notification message to the first vehicle warning of a pending red light violation.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Exemplary embodiments include methods, systems and computer program products for providing a red light violator warning. In exemplary embodiments, roadside equipment at an intersection is configured to detect that a vehicle approaching the intersection is likely going to violate a red light. In response to detecting that a vehicle approaching the intersection is likely going to violate a red light, the roadside equipment is configured to notify other vehicles at the intersection of the pending red light violation. In one embodiment, the notification includes sending warning messages to vehicles at the intersection that are capable of receiving messages from the roadside equipment. In exemplary embodiments, the notification also includes sending a notification message to the vehicle that is about to violate the red light.

Figure 1:
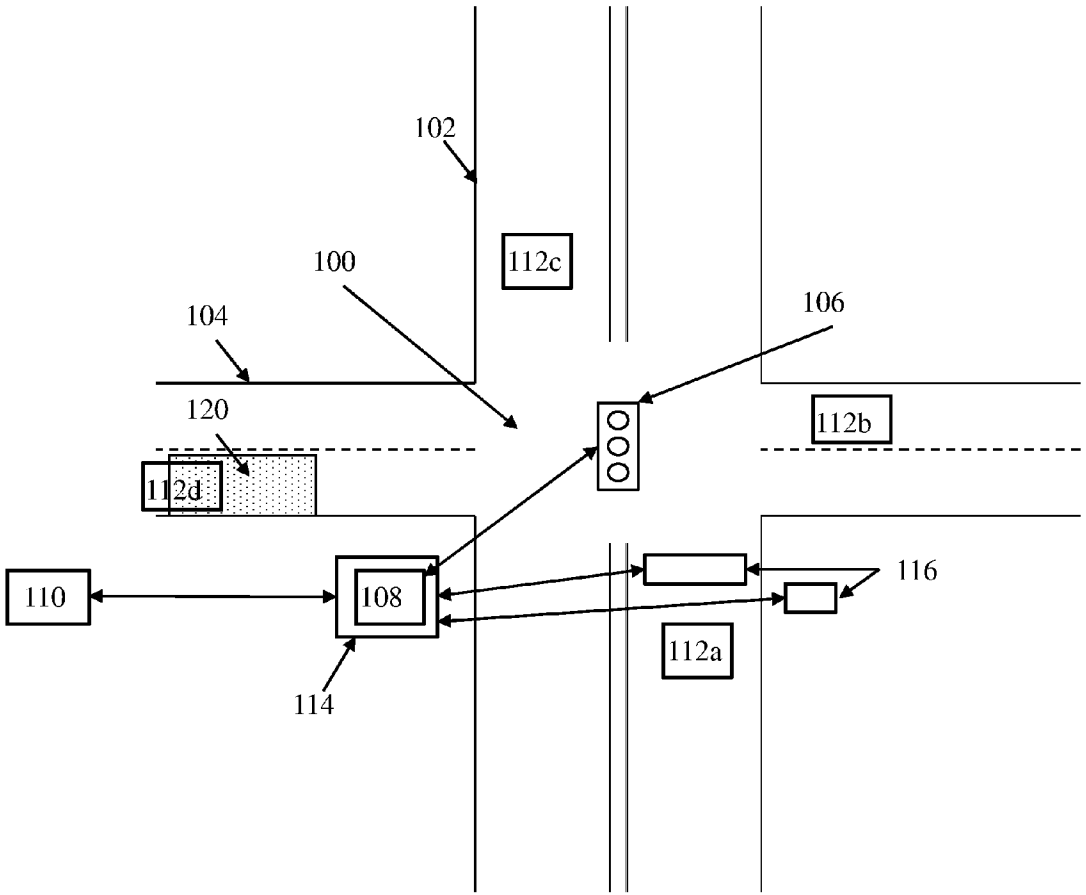
FIG. 1 is a schematic diagram illustrating an intersection in accordance with an exemplary embodiment.

Referring now to FIG. 1, a block diagram of an intersection 100 in accordance with an exemplary embodiment is shown. As illustrated, the intersection 100 of a main street 102 and a side street 104 includes a traffic signal 106 that is configured to control the flow of vehicles 112*a*-112*d* through the intersection 100. In exemplary embodiments, the traffic signal 106 is controlled by a traffic signal controller 108, which is part of roadside equipment 114. In exemplary embodiments, the roadside equipment 114 is in communication with a traffic management system 110 and one or more of the vehicles 112*a*-112*d* may be configured communicate with the roadside equipment 114 via wireless communication devices. In exemplary embodiments, the management system 110 may be connected to the roadside equipment 114 by a fiber optic cable, copper wire, or by other suitable means. In exemplary embodiments, the traffic signal controller 108 may receive signal control plans from the traffic management system 110 which are used to govern the operation of the traffic signal 106 during different times of the day and days of the week. In exemplary embodiments, the roadside equipment 114 includes all of the equipment needed to control the signal 106 for the intersection 100. While the roadside equipment 114 is illustrated as a single device, those of ordinary skill in the art will understand that the roadside equipment 114 may comprise multiple pieces of equipment located in the vicinity of the intersection 100.

In exemplary embodiments, the roadside equipment 114 is configured to communicate with sensors 116, which are configured to detect the presence of a car. In exemplary embodiments, the traffic signal controller 108 receives input signals from the sensors 116 and calculates that a pending violation of a red light of the traffic signal 106 is about to occur. For example, the traffic signal controller 108 may determine, based on readings from the sensors 116, that vehicle 112*a* is approaching a red light at the intersection 100 at a rate of speed which will likely result in the vehicle 112*a* violating the red light. In exemplary embodiments, the sensors 116 may include cameras, radar equipment, transceivers, proximity sensors in the road, or the like. The traffic signal controller 108 may use one or more sensors 116 individually or in a variety of combinations to detect that a vehicle is about to violate a red light of the intersection.

In response to detecting the pending red light violation, the roadside equipment 114 will broadcast a warning message of the pending red light violation. In exemplary embodiments, not all vehicles 112*a*-112*c* are able to receive messages from the roadside equipment 114. For example, vehicle 112*b* may include the necessary wireless communications equipment to receive the warning message broadcast by the roadside equipment 114 while vehicle 112*c* may not be able to receive the warning message broadcast by the roadside equipment 114. In exemplary embodiments, upon receiving the warning message the vehicle 112*b* alerts the driver of the vehicle 112*b* that another vehicle 112*a* is about to violate a red light. Depending on the type of alert used, the vehicle 112*b* may also inform the driver of the direction of travel of the vehicle 112*a* that is about to violate the red light.

In exemplary embodiments, the warning message broadcast by the roadside equipment 114 can be received by connected devices near the intersection 114. As used herein, the term connected devices refers to any device which has the necessary wireless communications equipment to send and/or receive messages from roadside equipment. For example, a smartphone or tablet near the intersection 100 may be capable of receiving the warning message broadcast by the roadside equipment 114. Likewise, the term connected vehicle refers to a vehicle which has the necessary wireless communications equipment to send and/or receive messages from roadside equipment. In exemplary embodiments, upon receiving the warning message the connected device alerts the user of the connected device that a vehicle 112*a* is about to violate a red light. Depending on the type of alert used, the connected device may also inform the user of the direction of travel of the vehicle 112*a* that is about to violate the red light.

In exemplary embodiments, in response to detecting a pending red light violation by vehicle 112*a*, the roadside equipment 114 will determine if the vehicle 112*a* is a connected. If the vehicle 112*a* is a connected vehicle, the roadside equipment 114 will transmit a notification message to the vehicle 112*a* that notifies the vehicle 112*a* that it is about to violate a red light. In exemplary embodiments, the notification message instructs the vehicle 112*a* to take a warning action to warn other nearby vehicles that vehicle 112*a* is about to violate the red light. In exemplary embodiments, such a warning action may include, but is not limited to, one or more of: flashing of the headlights of vehicle 112*a*; flashing of the turn lights of vehicle 112*a*; flashing of the brake lights of vehicle 112*a*; honking a horn of vehicle 112*a*; activating the windshield wipers of vehicle 112*a*; or the like.

It will be appreciated by those of ordinary skill in the art that the methods and systems used to provide a red light violator warning as described above can be adapted to provide a stop sign violator warning as well. For example, the roadside equipment may determine that vehicle is about to run a stop sign based on one or more signals from sensors near an intersection. Based on determining that a vehicle is about to run a stop sign, the roadside equipment may transmit a notification message to the vehicle and a warning message to all connected devices in proximity of the intersection.

Figure 2:
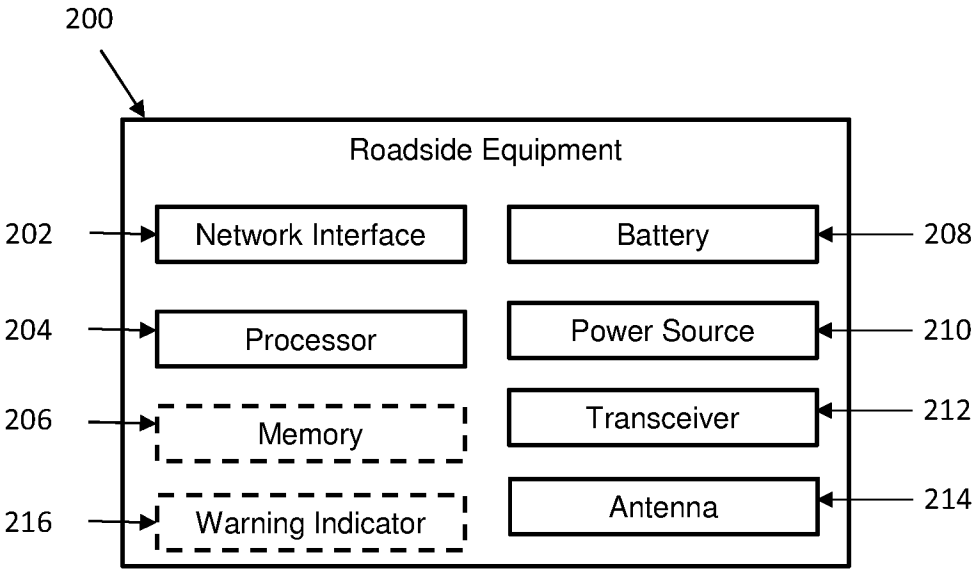
FIG. 2 is a block diagram of roadside equipment in accordance with an exemplary embodiment.

Referring now to FIG. 2, a block diagram of roadside equipment 200 in accordance with an exemplary embodiment is shown. As illustrated, the roadside equipment 200 includes a network interface 202, a processor 204, a memory 206, a battery 208, a power source 210, a transceiver 212, and an antenna 214. In one embodiment, the network interface 202 is configured to connect the roadside equipment 200 to a traffic management system via an Ethernet cable. The roadside equipment 200 is configured to receive information from the traffic management system and to use the processor 204 and the memory 206 to process and store the received information. In exemplary embodiments, the memory 206 may include any of a wide variety of memory devices including volatile and non-volatile memory devices. In exemplary embodiments, the processor 204 may include one or more processing unit and at least one of the processing units is configured to operate as the traffic signal controller.

In exemplary embodiments, the roadside equipment 200 is configured to receive power from power source 210 and to charge a battery 208. The battery 208 is configured to provide power to the roadside equipment 200 in the event of an interruption or failure of the power source 210. In exemplary embodiments, the power source 210 may be a power over Ethernet power source and the network interface 202 may be configured to receive both data and power over an Ethernet connection. In exemplary embodiments, the battery 208 may be a lead acid battery, a lithium ion battery, a nickel cadmium battery or the like.

In exemplary embodiments, the roadside equipment 200 includes multiple transceivers 212 and antennas 214 which are each configured to communicate on different communications channels, or frequencies. In other embodiments, the roadside equipment 200 may be configured to use a single antenna 214 and transceiver 212 to communicate over a range of communications channels, or frequencies. In exemplary embodiments, the transceivers 212 and antennas 214 of the roadside equipment 200 are configured to communicate with connected vehicles and other connected devices within range of the roadside equipment 200. For example, the transceivers 212 may include a 5.9 GHz short range wireless communications device that is capable of both sending and receiving messages from nearby vehicles.

In exemplary embodiments, the roadside equipment 200 may include a warning indicator 216 that is configured to be activated upon the determination that a vehicle is about to violate a red light of the intersection controlled by the roadside equipment 200. In exemplary embodiments, the warning indicator 216 may be a horn, a strobe light, or any other suitable device which is capable of alerting people in the vicinity of the intersection of a pending red light violation.

Those of skill in the art will recognize that not all details are shown in the simplified block diagram shown in FIG. 2. In exemplary embodiments, the antenna 214 may be dedicated to a single transceiver 212, or may be connected to be shared with other components. The processor 204 may be configured to perform only the processes described herein, or can also be configured to perform other processes for the operation and management the roadside equipment 200. The various components of the roadside equipment 200 as shown in FIG. 2 may be constructed as separate elements connected to communicate with each other or two or more of these components could be integrated into a single device.

Figure 3:
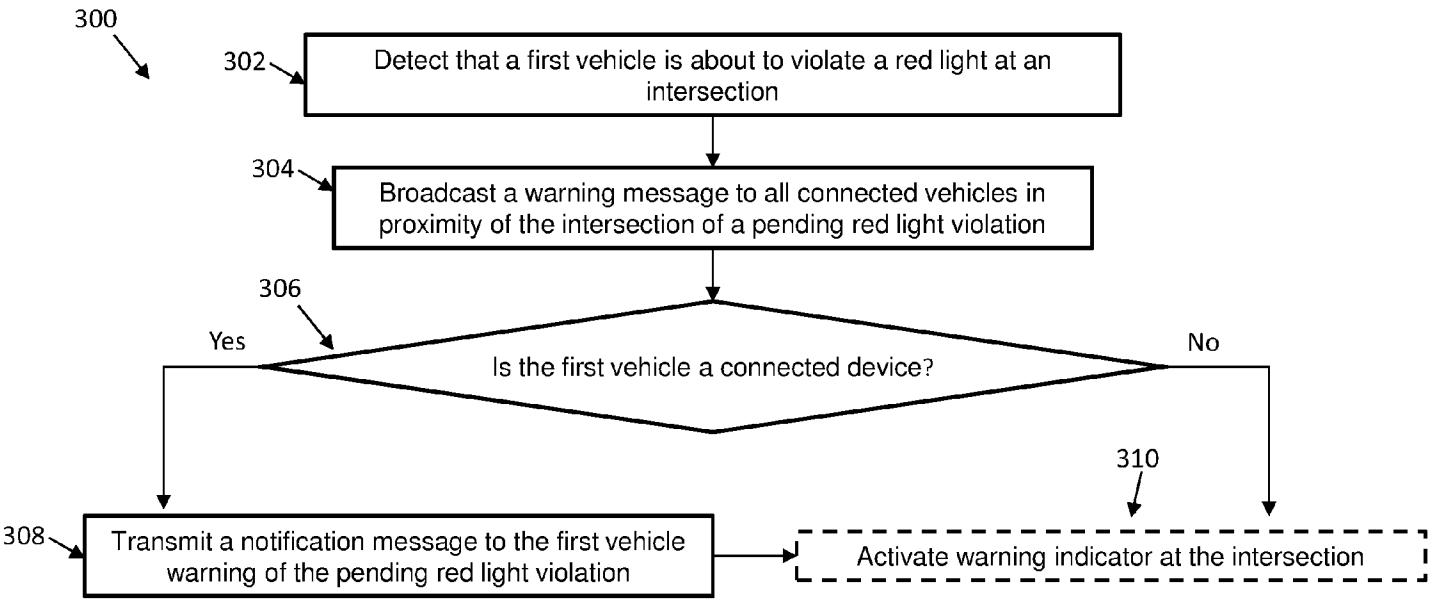
FIG. 3 is a flow chart diagram illustrating a method for providing a red light violator warning in accordance with an exemplary embodiment.

Referring now to FIG. 3, a flow chart diagram illustrating a method 300 for providing a red light violator warning in accordance with an exemplary embodiment is shown. As shown at block 302, the method 300 includes detecting that a first vehicle is about to violate a red light at an intersection. Next, as shown at block 304, the method 300 includes broadcasting a warning message to all connected devices in proximity of the intersection of a pending red light violation. As illustrated at decision block 306, the method includes determining if the first vehicle is a connected vehicle. If the first vehicle is a connected vehicle, the method proceeds to block 308 and transmits a notification message to the first vehicle warning of the pending red light violation. In exemplary embodiments, the notification message instructs the first vehicle to take a warning action to alert nearby individuals that the first vehicle is about to violate the red light. If the first vehicle is not a connected vehicle, the method 300 proceeds to block 310 and activates a warning indicator at the intersection if the roadside equipment includes a warning indicator. In exemplary embodiments, the method 300 may also proceed to block 310 and activate a warning indicator at the intersection if the roadside equipment includes a warning indicator after transmitting the warning message to the first vehicle.

Continuing with reference now to FIG. 1, in general as a driver approaches a traffic signal 106 at an intersection 100, the driver encounters a dilemma zone 120, which is defined as the area in which if the traffic signal 106 were to turn yellow, the driver would not instantly and instinctively know whether to stop or continue on. In exemplary embodiments, the size and location of the dilemma zone 120 may vary with the age and experience of the driver, with the driver's familiarity with the configuration of the intersection 100 and timing of the traffic signal 106, and based upon other factors such as the weather and road conditions.

In exemplary embodiments, a connected vehicle 112*d* is configured to activate a chime, or go tone, that would advise the driver to continue through the intersection 100 when the driver is in the dilemma zone 120. In exemplary embodiments, the chime will only sound within 100 ms of the traffic signal 106 changing yellow and if and only if the distance, speed, probably traction conditions and congestion would allow the vehicle 112*d* to clear the intersection 100 safely. In exemplary embodiments, the determination of whether to active the chime accounts for the yellow and red clearance times programmed for the approach to the intersection 100. In one embodiment, determination of whether to active the chime accounts for environmental conditions in the vicinity of the intersection 100. The chime will only sound if the vehicle 112*d* is near the dilemma zone 120 at the instant the traffic signal 106 changed to yellow, for example within 2 seconds of a safe stop point. In exemplary embodiments, the driver of the vehicle 112*d* will have the option to disable the chime when driving familiar streets.

In exemplary embodiments, the determination of whether to active the chime in a connected vehicle may be made by the vehicle 112*d* or by the roadside equipment 114. For example, in one embodiment, the vehicle 112*d* receives information from the roadside equipment 114 regarding the changing traffic signal 106 and based on the location and speed of the vehicle 112*d*, the vehicle 112*d* determines whether to active the chime. In another embodiment, the roadside equipment 114 may instruct the vehicle 112*d* to activate the chime based on the traffic signal plan and one or more readings from the sensors 116 near the intersection 100.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A method for providing a red light violator warning, the method comprising:

detecting that a first vehicle is about to violate a red light at an intersection;

based on detecting that the first vehicle is about to violate the red light at the intersection:

broadcasting a warning message to all connected vehicles in proximity of the intersection of a pending red light violation; and determining if the first vehicle is a connected vehicle;

based on determining that the first vehicle is a connected vehicle, transmitting a notification message to the first vehicle warning of a pending red light violation.

2. The method of claim 1, wherein a connected vehicle is a vehicle that comprises wireless communications equipment capable of receiving messages from a roadside equipment.

3. The method of claim 1, further comprising:

based on determining that the first vehicle is not a connected vehicle and that the first vehicle is about to violate the red light at the intersection, activating a warning indicator at the intersection.

4. The method of claim 3, wherein the warning indicator a horn, a strobe light, or any other suitable device which is capable of alerting vehicles in proximity of the intersection of the pending red light violation.

5. The method of claim 1, further comprising:

based on detecting that the first vehicle is about to violate the red light at the intersection, activating a warning indicator at the intersection.

6. The method of claim 5, wherein the warning indicator a horn, a strobe light, or any other suitable device which is capable of alerting vehicles in proximity of the intersection of the pending red light violation.

7. The method of claim 1, wherein the notification message instructs the first vehicle to take a warning action to warn vehicles in proximity of the intersection of the pending red light violation.

8. The method of claim 7, wherein the warning action includes at least one of the following:

flashing of the headlights of the first vehicle;
flashing of the turn lights of the first vehicle;
flashing of the brake lights of the first vehicle;
honking a horn of the first vehicle; and
activating the windshield wipers of the first vehicle.

9. A roadside equipment comprising:

a processor configured to operate a traffic signal for an intersection, the processor configured to perform a method comprising:

detecting that a first vehicle is about to violate a red light at the intersection;

based on detecting that the first vehicle is about to violate the red light at the intersection:

broadcasting a warning message to all connected vehicles in proximity of the intersection of a pending red light violation; and determining if the first vehicle is a connected vehicle;

based on determining that the first vehicle is a connected vehicle, transmitting a notification message to the first vehicle warning of a pending red light violation.

10. The roadside equipment of claim 9, wherein a connected vehicle is a vehicle that comprises wireless communications equipment capable of receiving messages from the roadside equipment.

11. The roadside equipment of claim 9, where the method performed by the processor further comprises:

based on determining that the first vehicle is not a connected vehicle and that the first vehicle is about to violate the red light at the intersection, activating a warning indicator at the intersection.

12. The roadside equipment of claim 11, wherein the warning indicator a horn, a strobe light, or any other suitable device which is capable of alerting vehicles in proximity of the intersection of the pending red light violation.

13. The roadside equipment of claim 9, where the method performed by the processor further comprises:

based on detecting that the first vehicle is about to violate the red light at the intersection, activating a warning indicator at the intersection.

14. The roadside equipment of claim 13, wherein the warning indicator a horn, a strobe light, or any other suitable device which is capable of alerting vehicles in proximity of the intersection of the pending red light violation.

15. The roadside equipment of claim 9, wherein the notification message instructs the first vehicle to take a warning action to warn vehicles in proximity of the intersection of the pending red light violation.

16. The roadside equipment of claim 15, wherein the warning action includes at least one of the following:

flashing of the headlights of the first vehicle;
flashing of the turn lights of the first vehicle;
flashing of the brake lights of the first vehicle;
honking a horn of the first vehicle; and
activating the windshield wipers of the first vehicle.

17. A computer program product for providing a red light violator warning, the computer program product comprising:

a tangible storage medium readable by a processing circuit and storing instructions for execution by the processing circuit for performing a method comprising:

detecting that a first vehicle is about to violate a red light at an intersection;

based on detecting that the first vehicle is about to violate the red light at the intersection:

broadcasting a warning message to all connected vehicles in proximity of the intersection of a pending red light violation; and determining if the first vehicle is a connected vehicle;

based on determining that the first vehicle is a connected vehicle, transmitting a notification message to the first vehicle warning of a pending red light violation.

18. The computer program product of claim 17, wherein a connected vehicle is a vehicle that comprises wireless communications equipment capable of receiving messages from a roadside equipment.

19. The computer program product of claim 17, wherein the notification message instructs the first vehicle to take a warning action to warn vehicles in proximity of the intersection of the pending red light violation.

20. The computer program product of claim 19, wherein the warning action includes at least one of the following:

flashing of the headlights of the first vehicle;
flashing of the turn lights of the first vehicle;
flashing of the brake lights of the first vehicle;
honking a horn of the first vehicle; and
activating the windshield wipers of the first vehicle.

* * * * *